US005558697A

United States Patent [19]

Dyson et al.

[11] Patent Number: 5,558,697

[45] Date of Patent: Sep. 24, 1996

[54] DUAL CYCLONIC VACUUM CLEANER

[75] Inventors: James Dyson, Chippenham, United Kingdom; Allan D. Millman, Toronto; Tat-Chi A. Tsui, St. Catherines, both of Canada

[73] Assignee: Notetry Limited, Chippenham, United Kingdom

[21] Appl. No.: 360,653

[22] PCT Filed: Jun. 24, 1930

[86] PCT No.: PCT/GB93/01325

§ 371 Date: Apr. 17, 1995

§ 102(e) Date: Apr. 17, 1995

[87] PCT Pub. No.: WO94/00046

PCT Pub. Date: Jan. 6, 1994

[30] Foreign Application Priority Data

Dec. 8, 1992 [GB] United Kingdom ..... 9225599

[51] Int. Cl.[6] ..... B01D 45/00

[52] U.S. Cl. ..... 95/12; 55/266; 55/310; 55/311; 55/345; 55/420; 95/19; 95/271

[58] Field of Search ..... 15/353; 55/261, 55/266, 309, 310, 311, 313, 345, 420, 459.5, 344, 419; 95/271, 12, 19

[56] References Cited

U.S. PATENT DOCUMENTS

| | | | |
|---|---|---|---|
| 935,658 | 10/1909 | Joedicke | 55/309 |
| 2,684,232 | 7/1954 | Caldwell | 55/309 |
| 2,837,172 | 6/1958 | Klein et al. . | |
| 3,008,543 | 11/1961 | Bourdale et al. | 55/309 |
| 3,199,269 | 8/1965 | Oehlrich et al. | 55/459.5 |
| 3,308,609 | 3/1967 | McCulloch et al. . | |
| 3,425,192 | 2/1969 | Davis . | |
| 4,373,228 | 2/1983 | Dyson | 15/350 |
| 4,593,429 | 6/1986 | Dyson | 15/353 |
| 5,281,245 | 1/1994 | Yang | 55/345 |
| 5,294,218 | 3/1994 | Fiorentini et al. | 55/309 |

FOREIGN PATENT DOCUMENTS

| | | | |
|---|---|---|---|
| 1162362 | 1/1984 | Canada . | |
| 1159610 | 2/1984 | Canada . | |
| 1182613 | 2/1985 | Canada . | |
| D. 54448 | 5/1985 | Canada . | |
| D. 60796 | 5/1988 | Canada . | |
| 1238869 | 7/1988 | Canada . | |
| 1241158 | 8/1988 | Canada . | |
| 0042723 | 12/1981 | European Pat. Off. . | |
| 0134654 | 3/1985 | European Pat. Off. . | |
| 0489565 | 6/1992 | European Pat. Off. . | |
| 831357 | 9/1938 | France | 55/420 |
| 543335 | 2/1932 | Germany | 55/420 |
| 47-3955 | 2/1972 | Japan | 55/459.5 |
| 47-13225 | 4/1972 | Japan . | |
| 4361721 | 12/1992 | Japan . | |

*Primary Examiner*—C. Scott Bushey
*Attorney, Agent, or Firm*—Ian C. McLeod

[57] ABSTRACT

A vacuum cleaner including a dirty air inlet (12, 14) communicating with a clean air outlet by way of an airflow path has a cyclone (18) arranged in the airflow path. In use, air flowing along the airflow path from the dirty air inlet (12, 14) to the clean air outlet passes through the cyclone (18). At least one bleed valve (20) is arranged in the wall of the airflow path upstream of the cyclone (18). Preferably, three bleed valves (20) are located in the wall of the airflow path and, more preferably, the bleed valves (20) are substantially identical to one another. Control may be provided for controlling the amount of air bled through the bleed valve (76) when a single bleed valve is provided.

29 Claims, 3 Drawing Sheets

DUAL CYCLONIC VACUUM CLEANER

BACKGROUND OF THE INVENTION

The invention relates to a vacuum cleaner, particularly but not exclusively to a dual cyclonic vacuum cleaner.

A dual cyclonic vacuum cleaner comprises a dirty air inlet communicating with a clean air outlet by means of an airflow path, two cyclones being sequentially arranged in the airflow path. In use, air flowing along the airflow path from the dirty air inlet to the clean air outlet passes through a first of the two cyclones and subsequently through a second of the two cyclones. The first cyclone is a "low efficiency" cyclone designed to remove relatively large particles from the airflow, whilst the second, "high efficiency" cyclone is designed to remove fine dust particles from the airflow. A vacuum cleaner having these features expels air which is dirt- and dust-free to a higher degree than other known vacuum cleaners. Examples of such vacuum cleaners are known from published European application No. 0489565 and European patents Nos. 0042723 and 0134654.

Another advantage of the dual cyclonic vacuum cleaner is that the dirt-collecting chambers are highly unlikely to become blocked because of the size and rigidity of the chambers. However, it is inevitable that the dirty air inlet, either in the form of a cleaner head or a tool attached to a hose or wand, can become blocked to a greater or lesser extent. Naturally, this reduces the airflow along the airflow path. A single cyclonic vacuum cleaner operates in the same manner but utilises only one cyclone which can become inefficient if the airflow rate though the cyclone is reduced.

Vacuum cleaner airflow rates are measured at various orifice sizes. The flow rates start at an effective orifice size of 50 mm diameter and are reduced to zero at zero diameter. Any flow rate in any given machine therefore has an equivalent "effective orifice" size. In practice, a vacuum cleaner being used through a hose or wand typically has an effective orifice size of 32 mm diameter if it is fully open. A vacuum cleaner operating on a carpet through a cleaner head has an effective orifice of about 19 mm diameter. A crevice tool being used on the end of a wand handle may have an effective orifice of about 15 mm diameter. Thus it can been seen that, in its normal range of use, a vacuum cleaner has to deal with airflows equivalent to those obtained through orifices of from 15 mm to 32 mm diameter.

At all of these flow rates achieved in normal use, the second cyclone of a dual cyclonic vacuum cleaner maintains a good Level of fine dust separation. However, it has been found that the separation efficiency of the second cyclone is reduced if the airflow rate through the second cyclone is reduced to below that of an effective orifice size of 13 mm. This can be caused by a number of things; for example, a blockage occurring at any point along the airflow path, or by the user putting a hand or other object over the air inlet. Furthermore, the efficiency of the second cyclone is reduced if the flow is interrupted in a pulsing manner or if the suction through the cleaner head causes the cleaner head to seal itself partially or completely against the surface to be cleaned. A similar problem arises when the airflow through the cyclone of a single cyclonic vacuum cleaner is reduced.

Depending upon the specific design of the cyclonic vacuum cleaner, the air discharged from a cyclonic vacuum cleaner may be substantially dust free and may in fact be cleaner than the air which is emitted from a vacuum cleaner which utilises a bag or other filter media. However, under certain operating conditions, cyclonic vacuum cleaners may emit larger than desired quantities of fine particulate matter. For example, if the vacuum cleaner picks up a particularly heavy concentration of fine particulate matter, part of the fine particulate matter may pass through the two cyclones and be exhausted from the second cyclone. This may result in the deposition in a room of a layer of fine dust particles. Further, the filtered exhaust air may be passed by the,, motor housing to cool the motor. If the exhaust air occasionally includes more than desired quantities of fine particulate matter, the motor may experience a build up of fine particulate matter which could decrease; the life expectancy of the motor.

SUMMARY OF THE INVENTION

It is therefore an object of the invention to maintain a high standard of dust separation in the second cyclone even when the airflow in the vacuum cleaner falls to a rate below that of an effective orifice size of 13 mm. It is a further object of the present invention to provide a cyclonic vacuum cleaner which maintains good separation standards at all airflow rates through the dirty air inlet.

The invention provides a vacuum cleaner comprising a dirty air inlet communicating with a clean air outlet by means of an airflow path, a cyclone being arranged in the airflow path such that, in use, air flowing along the airflow path from the dirty air inlet to the clean air outlet passes through the cyclone, characterised in that at least one bleed valve is provided, downstream of the dirty air inlet, for introducing bled air into the cyclone to maintain the air flow therein, the or each bleed valve being operable when, in use, either the pressure of the air flowing along the airflow path falls to or below a predetermined level or the amount of particulates in the air at or adjacent the clean air outlet exceeds a predetermined level. The bleed valve operates so as to maintain the airflow rate in the cyclone and thus retain efficient dust separation therein.

Advantageously, the at least one bleed valve is arranged in the wall of the air flow path upstream of the cyclone. Alternatively, the at least one bleed valve could be arranged in the wall of the cyclone adjacent the inlet thereto.

Preferably, two cyclones are arranged sequentially in the airflow path, the bleed valve or valves being arranged between the two cyclones. This arrangement means that the efficiency of the second cyclone is maintained.

Advantageously, a plurality of bleed valves are provided; preferably three. This arrangement allows the bled air to be introduced to the airflow in the vacuum cleaner in increments so that the airflow from the dirty air inlet is not substantially reduced in a single step. Any reduction that occurs is made in increments with the incremental introduction of bled air.

It is preferred that all the bleed valves are substantially identical to one another; i.e. they have the same effective area and are designed to open at the same pressure conditions. This gives a satisfactory gradual transfer from the state of no bled air being introduced to the cyclone to the state of all of the air introduced to the cyclone being bled. It is important that this transfer be gradual to allow cleaning to be maintained either through a tool at the end of the wand or through the cleaning head, even to the point at which the last valve is actuated, which is a very blocked condition.

It is preferred that the or each bleed valve is designed to open when the pressure in the airflow path is that produced by an airflow equivalent to an effective orifice of between 10 mm and 15 mm diameter or less. More preferably, the or each bleed valve is designed to open when the pressure in the airflow path is that produced by an airflow equivalent to an effective orifice of 13 mm diameter or less. This ensures that an airflow equivalent to an effective orifice of 13 mm diameter is maintained in the cyclone and thus that the separation efficiency is maintained.

It is advantageous if the or each bleed valve is spring-loaded and if the effective area, or total effective area, of the or each bleed valve is between 120 $mm^2$ and 150 $mm^2$, preferably substantially 132 $mm^2$, i.e. the area of an effective orifice of 13 mm diameter.

It should be noted that, by maintaining an airflow of at least an effective orifice diameter of 13 mm diameter, an airflow sufficient to cool the motor of the cleaner is ensured. This means that the risk of the motor overheating is minimised. Furthermore, the maintenance of the airflow to achieve satisfactory separation means that there is no substantial risk of damage to the motor.

In an alternative embodiment, the vacuum cleaner may also include adjustment means for varying the size of a single bleed valve for controlling the flow of bled air into the second cyclone, so that an increased flow of bled air can be admitted when the vacuum cleaner is used, for example, to vacuum a large concentration of fine particulates. The adjustment means may advantageously comprise a movably mounted door. The door may be moveable between a first position in which it restricts the flow of bled air through the bleed valve and a second position in which the door restricts the flow of bled air through the bleed valve to a lesser extent than when the door is in the first position. Means mounting the door for a decrease in pressure in the cyclone to move the door from the said first position towards the second position may also be provided. Furthermore, means biasing the door into the first position, whereby the door will move towards the second position as the pressure in the cyclone decreases thereby admitting an increased flow of bled air into the cyclone may also be provided.

In a further alternative embodiment, the vacuum cleaner may include sensing means coupled to the outlet for sensing the amount of particulates in the exhausted air and for producing an output indicative thereof. The vacuum cleaner may also have control means coupled between the sensing means and the door, the control means being responsive to the output signal for operating the door to permit an increased flow of bled air into the cyclone when an increased amount of particulates is detected in the exhaust.

In accordance with this invention, a method is also provided of operating a cyclonic vacuum cleaner having first and second cyclones arranged in series. The method includes admitting dirty air into the first cyclone, partially cleaning the dirty air in the first cyclone to produce partially filtered air and conducting the partially filtered air from the first cyclone to the second cyclone. The partially filtered air is further cleaned in the second cyclone to produce further cleaned air and is exhausted from the second cyclone. Bled air is admitted, in addition to the partially filtered air, into the second cyclone for reducing particulates in the further cleaned air.

It has been found that the provision of bled air to the second cyclone reduces the particulate emission in the exhaust from the second cyclone. Without being limited by theory, it is believed that the bled air probably reduces the disturbance to the cyclone action caused by heavy concentrations of fine particulates, or by disturbing pulsations which occur when sealed or partially sealed suction begins and ends, or other disturbances. Accordingly, even when the vacuum cleaner is used to vacuum a large concentration of particulates, or engages the surface to be cleaned, causing a partial or fully sealed suction condition, the particulate emission from the vacuum cleaner may be greatly reduced.

BRIEF DESCRIPTION OF THE DRAWING

An embodiment of the invention will now be described with reference to the accompanying drawings, wherein.

DESCRIPTION OF THE PREFERRED EMBODIMENTS

Figure 1A:
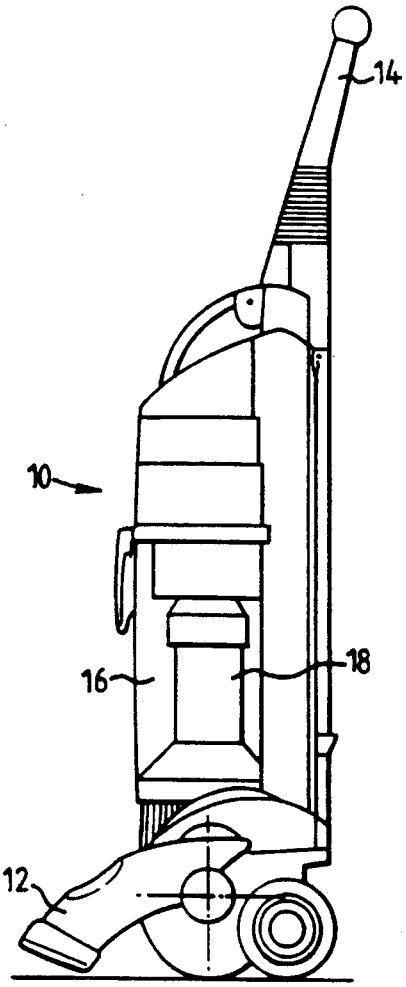
FIG. 1*a* is a side view of a first embodiment of a dual cyclonic vacuum cleaner incorporating the invention in a first position.

A vacuum cleaner comprising a dirty air (12, 14) inlet communicating with a clean air outlet by means of an airflow path, a cyclone (18) being arranged in the airflow path such that, in use, air flowing along the airflow path from the dirty air inlet (12, 14) to the clean air outlet passes through the cyclone (18), characterized in that at least one bleed valve (20) is provided, downstream of the dirty air inlet (12, 14), for introducing bled air into the cyclone (18) to maintain the air flow therein, the or each bleed valve (20) being operable when, in use, either the pressure of the air flowing along the air flow path falls to or below a predetermined level or the amount of particulates in the air at or adjacent the clean air outlet exceeds a predetermined level and a method of operating a cyclonic vacuum cleaner having first and second cyclones (16, 18) arranged in series, comprising the steps of: admitting dirty air into the first cyclone (16); partially cleaning the dirty air in the first cyclone (16) to produce partially filtered air; conducting the partially filtered air from the first cyclone (16) to the second cyclone (18); further cleaning the partially filtered air in the second cyclone (18) to produce further cleaned air; and exhausting the further cleaned air from the second cyclone (18): characterized in that bled air is admitted, in addition to the partially filtered air, into the second cyclone (18) for reducing particulates in the further cleaned air.

A typical dual cyclonic vacuum cleaner is shown in FIG. 1*a* in its non-operational position. The vacuum cleaner comprises a main body 10 incorporating a cleaning head 12 and a handle 14 which can be released for use in the manner of a wand. Various tools and attachments for the wand may be provided but are not shown. The means by which the handle 14 is released and the means by which the airflow is directed from either the handle 14 or the cleaning head 12 do not form part of the present invention and are described in other patents and applications. They will not be described further here.

Figure 1B:
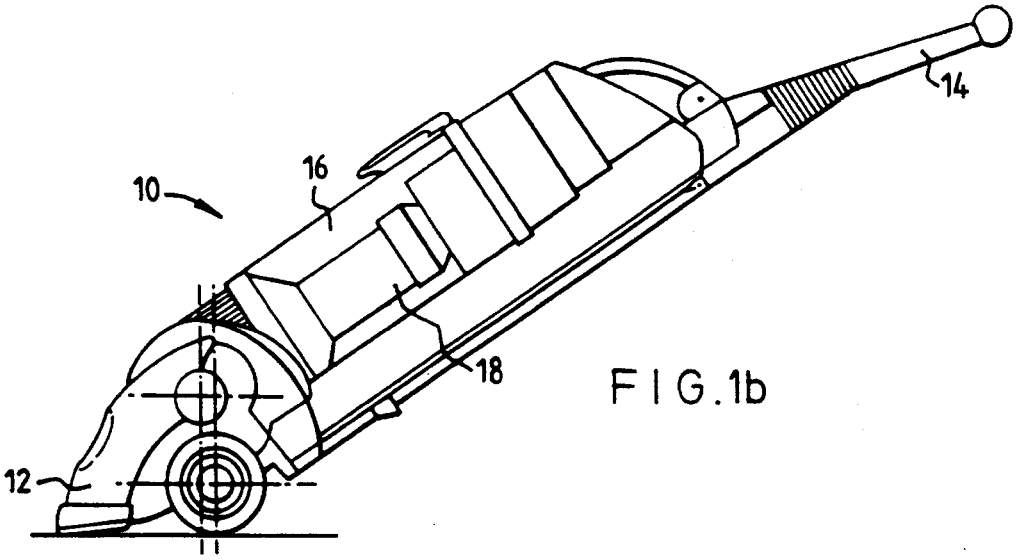
FIG. 1*b* is a side view of the cleaner of FIG. 1*a* shown in an alternative position.

The main body 10 incorporates a first cyclone 16 and a second cyclone 18. The first cyclone is a "low efficiency" cyclone designed to remove relatively large particles from the air flowing therethrough. The second cyclone 18 is designed as a "high efficiency" cyclone for removing fine dust particles from the airflow. In use, when the vacuum cleaner is in the position shown in FIG. 1*a*, the "cylinder" mode, the dirty air inlet is formed by the nozzle in the handle 14 which is removed and used in the manner of a wand. The airflow is directed from this dirty air inlet to the first, low efficiency cyclone, subsequently to the second, high efficiency cyclone, and then expelled to atmosphere via an exit (not shown). Normally, the airflow would be directed past the motor to give a cooling effect before being expelled. When the cleaner is to be used in the "upright" mode as shown in FIG. 1*b*, the dirty air inlet is formed by the cleaning head 12 and the airflow is directed from there to the first cyclone and then to the clean air exit via the second cyclone.

Figure 2:
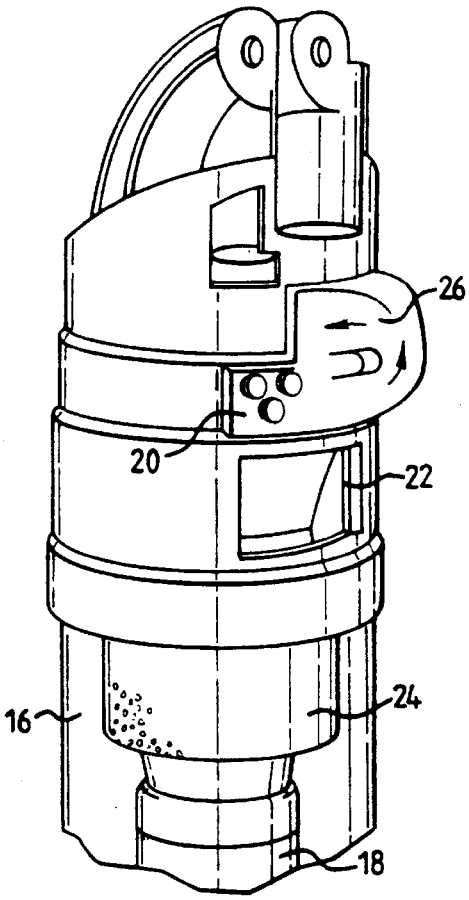
FIG. 2 is a perspective view of the upper portion of the cyclone assembly forming part of the cleaner shown in FIGS. 1*a* and 1*b;*

As mentioned in the introduction, it has been found that, when a blockage occurs in the dirty air inlet 12, 14 to such an extent that the airflow through the second cyclone 18 falls to an effective orifice of 13 mm diameter or less then the dust separation efficiency of the second cyclone decreases. Bleed valves 20 are therefore positioned in the wall of the airflow passage between the exit from the first cyclone and the entry to the second cyclone. The location of the bleed valves 20 is shown in FIG. 2. The airflow enters the first cyclone 16 via the entry port 22 and exits the first cyclone via the mesh screen 24. The air passes upward to the entry port 26 to the second cyclone 18 and it is immediately before this entry port 26 that the bleed valves 20 are located.

Figure 3:
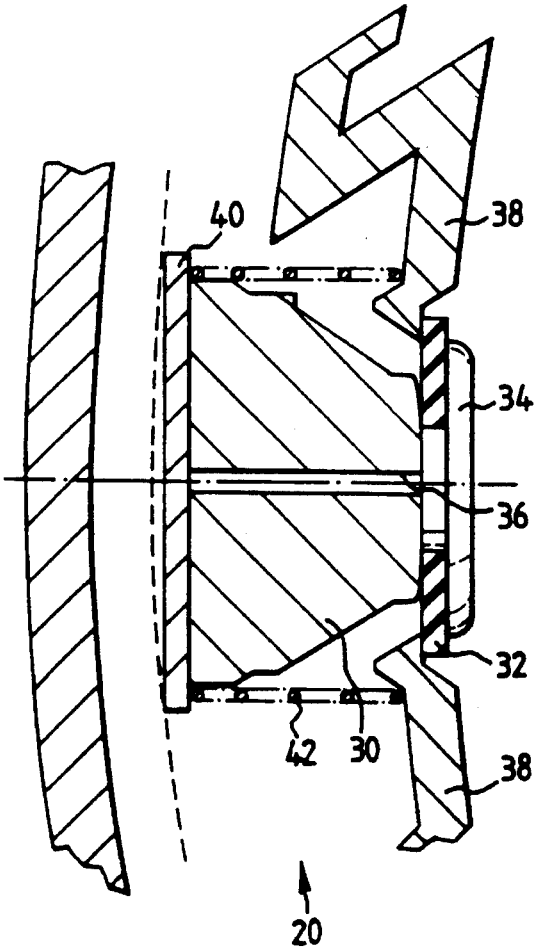
FIG. 3 is an enlarged sectional view through a bleed valve forming part of the invention.

Three bleed valves 20 are located in the wall of the airflow path. Each bleed valve 20 is shown in greatly enlarged cross-section in FIG. 3. Each valve 20 comprises a valve body 30 to which is attached a rubber washer 32 by means of a fixing disk 34. The fixing disk 34 passes through an aperture i n the rubber was her 32 and engages with an aperture 36 in the valve body. Alternative fixing means can, of course, be used. Acting between the airflow passage wall 38 and a flange 40 located on the valve body 30, is an air bleed valve spring 42. The spring 42 presses the flange 40 away from the airflow passage wall 38 so that the rubber washer 32 is maintained in sealing contact with the edges of an aperture in the airflow passage wall 38. This situation prevails whilst the pressure inside the airflow passage (i.e. to the right of the airflow passage wall as viewed in FIG. 3) combined with the action of the spring 42 is sufficient to maintain the valve body in the position shown in FIG. 3. However, if the pressure in the airflow passage falls sufficiently, then the pressure acting on the valve body outside the airflow passage becomes sufficient to open the valve 20 by moving the valve body against the action of the spring 42 towards the right as shown in FIG. 3 and thereby opening the valve 20. Air from outside the airflow passage (ie. the atmosphere) is thus bled into the airflow passage.

Although the arrangement described above is preferred, it is equally possible to locate the bleed valve 20 in the wall of the second cyclone 18 adjacent the entry port 26. In this event, means must be provided to ensure that the bled air enters the cyclone 18 in a tangential manner, for example by a baffle plate (not shown).

It has been found that the provision of three substantially identical bleed valves 20 in the airflow passage wall 38 immediately before the second cyclone 18 allows a gradual bleeding of atmospheric air into the airflow passage. When the pressure in the airflow passage drops below the threshold pressure, a first bleed valve 20 opens and the pressure in the airflow passage is thereby increased, although it will be appreciated that the increased pressure will still be less than the ambient pressure due to the suction action of the motor. If the airflow from the dirty air inlet continues to fall, then a second bleed valve will open when the combined pressure of the airflow from the dirty air inlet and the bled air from the first open valve reaches the threshold pressure of the remaining valves. Again, the combined pressure is then increased and the third valve will only be actuated when the combined pressure of the airflow from the dirty air inlet and the two open valves falls to the threshold pressure thus allowing the third valve to open. In this way, an incremental increase in the bled air is achieved. This ensures that the cleaning effect at the dirty air inlet is maintained even though air is bled into the second cyclone. Furthermore, the airflow is maintained in the second cyclone and the air passing therethrough will be efficiently separated from dust particles. The air from the second cyclone can also be passed across the motor surface to provide a cooling effect.

It has been found advantageous if each of the three bleed valves has the same effective area. Ideally, the combined effective area of the three valves should be equivalent to the area of the effective orifice of the airflow at which the bleed valves are to be actuated. Thus, if the bleed valves are to be actuated at an airflow of an effective orifice of 13 mm diameter, then the combined total effective area of the valves should total 132 $mm^2$. If, however, the valves are to be actuated at an airflow equivalent to an effective orifice of 14 mm, then the bleed valves should have an effective combined area of 154 $mm^2$. This effective area should be equally divided between the number of bleed valves present; if three bleed valves are present then each should have an effective area of 51 $mm^2$ but if four bleed valves are present, then each should have an effective area of 38 $mm^2$. It should be noted that the effective and actual areas of each bleed valve are not the same. The actual area of the bleed valve is restricted by the presence of the valve body near the valve aperture. Thus the effective area of the bleed valve can be considerably less than the actual area of the aperture.

It is within this scope of this invention for any number of bleed valves to be positioned in the wall of the airflow path immediately before the inlet to the second cyclone. Clearly, the greater the number of bleed valves present, the smaller, the incremental steps are in which the bled air is introduced into the airflow path. This provides for an ever increasingly gradual introduction of bled air, but also an ever increasing cost and maintenance burden. The preferred number of bleed valves is therefore three. Also, the risk of the bleed valves themselves becoming blocked by the dirt and fluff particles introduced into the vacuum cleaner via the dirty air inlet is very small because the air passing the bleed valves has already passed through the first cyclone and all of the larger particles entrained with the dirty air have been removed.

Figure 5:
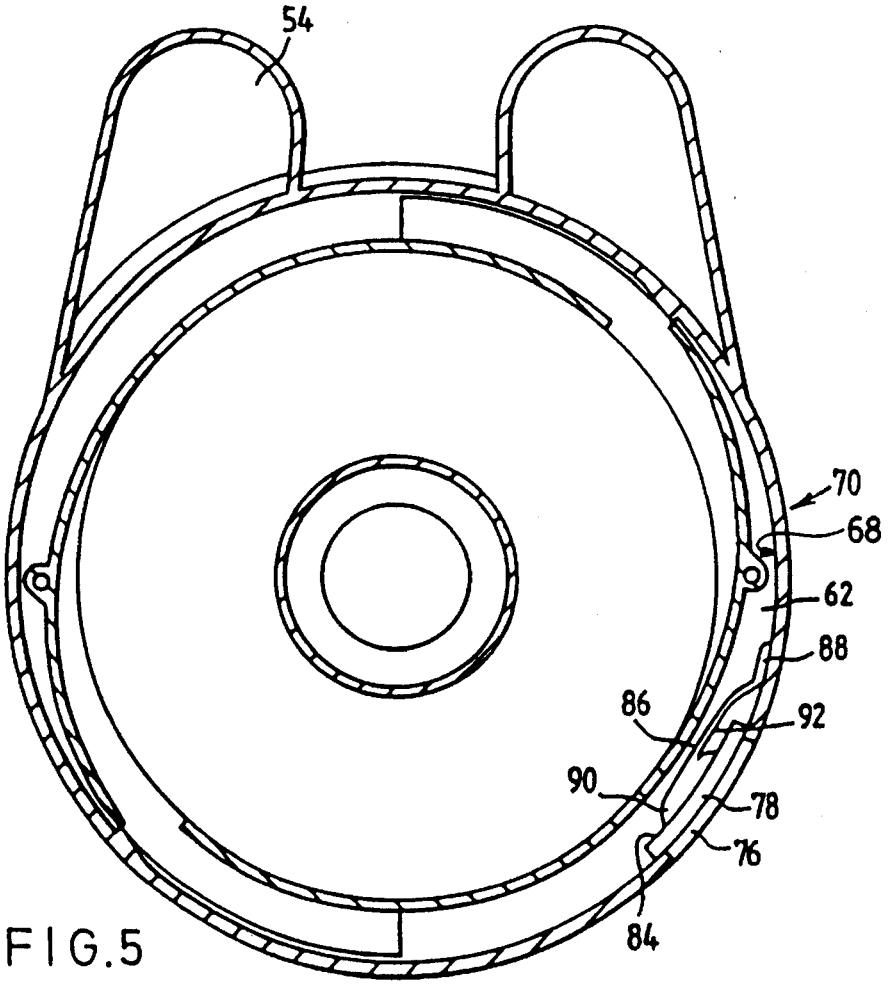
FIG. 5 is a cross sectional view through a third embodiment.
Figure 6:
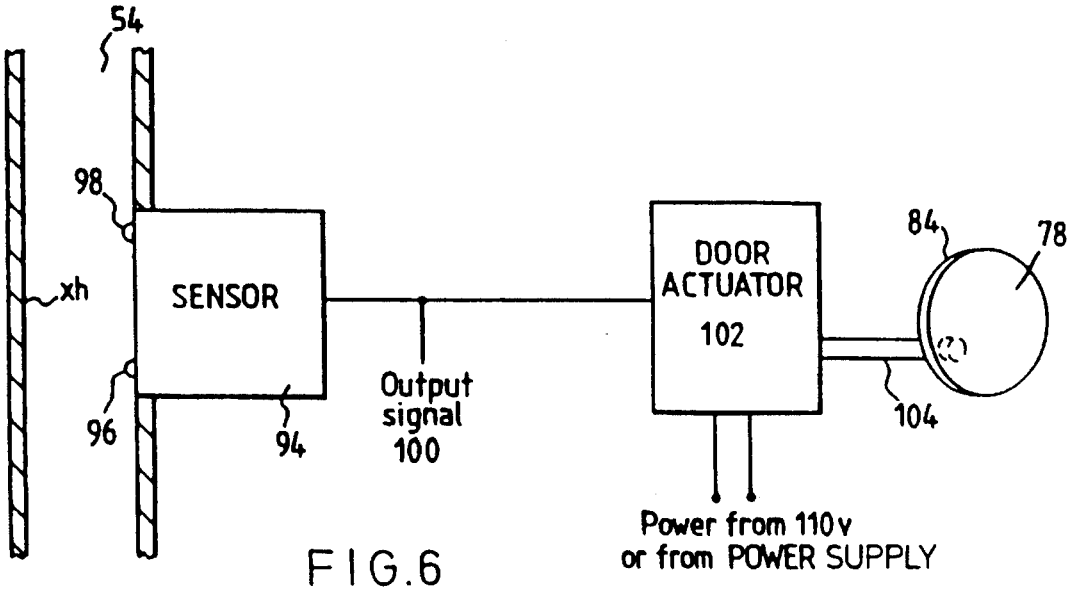
FIG. 6 is a schematic diagram relating to a fourth embodiment.

As will be appreciated, varying amounts of bled air may be required depending upon the particular conditions in which the vacuum cleaner is being operated. For example, if the vacuum cleaner is being operated in an area where there is a small concentration of particulates to be picked up, or on a surface or in an area where partial or full sealed suction will not occur, then less bled air, or alternatively no bled air, may be required. To this end, as shown in FIGS. 4, 5 and 6, the vacuum cleaner may also include means for varying the size of the bleed valve 76 and, accordingly, to control the volume of bled air passing into the second cyclone.

Figure 4:
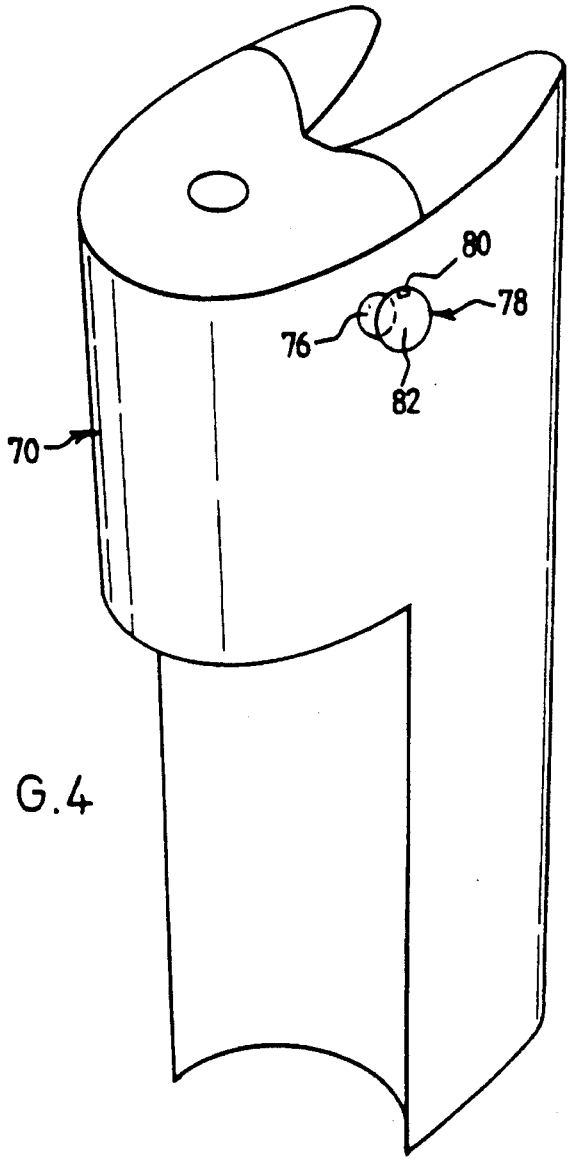
FIG. 4 is a perspective view of the housing of a second embodiment of a dual cyclonic vacuum cleaner incorporating the invention.

In the embodiment shown in FIG. 4, outer cyclone casing 70 is provided with a door 78. Door 78 is provided with a handle 80 at one end thereof. Door 78 is movably mounted on the outer cyclone casing 70 by means of a pivot 82 and is moveable between a closed position and an open position. Door 78 is sized so that when in the closed position, it completely covers bleed valve 76 and therefore prevents any bled air from entering through the bleed valve 76 into the second cyclone 18.

As shown in FIG. 4, door 78 is in a partially open position. During vacuuming, the operator may manually adjust the door 78 from a fully closed position to a partially opened position or from a partially opened position to a fully opened position so that an increased flow of bleed air can be admitted when the vacuum cleaner is used to vacuum a large concentration of fine particulates. Alternatively, the operator may elect to leave door 78 in the fully open position for most vacuuming purposes.

The bleed valve 76 may also be provided with automatic means for opening door 78 as the pressure in second cyclone 18 decreases. Such a decrease in pressure could occur when a condition of full or partially sealed suction occurs. An example of such an automatic means is shown in the alternative preferred embodiment which is shown in FIG. 5. Once again, bleed valve 76 is provided with a door 78 which, when in the closed position, fully covers bleed valve 76 thus preventing the entry of bled air into the second cyclone 18 during normal vacuuming conditions. Means biasing the door 76 into the closed position are also provided. Accordingly, the door will move towards the open position as the pressure in second cyclone 18 decreases thereby admitting an increased flow of bled air into the second cyclone as required.

As shown in FIG. 5, member 86 having a first end 88, a second end 90 and an arm 92 extending between first end 88 and second end 90 may be provided. First end 88 is fixedly attached to the inner surface 68 of outer cyclone casing 70. Second end 90 is fixedly attached to rear surface 84 of door 78. Arm 92 may be made from any material which will bias door 78 into the closed position which is shown in FIG. 5. For example, arm 92 may be made from a resilient material or may incorporate spring means, such as a leaf spring.

In operation, as the pressure inside second cyclone 18 decreases, the vacuum pressure within the air flow passage 62 will decrease to such a point that the inward force on the door 78 will become greater than the outward force on door 78 which is exerted by member 86 thus causing door 18 to deflect inwards away from the closed position and thus permitting bled air into the second cyclone. As the pressure inside the second cyclone increases (whilst remaining below the ambient pressure), at one point the vacuum pressure will increase sufficiently such that the outward force from member 86 will become greater than the vacuum pressure thus causing door 78 to move to the closed position.

In a further alternative embodiment, door 78 may be automatically controlled to allow bled air into second cyclone 18 in response to the amount of particulates which are exhausted from the air exit port of the second cyclone. As shown in FIG. 6, a sensor 94 may be provided on air exit shaft 54. Sensor 94 senses the amount of particulates in the exhaust from the second cyclone. To this end, sensor 94 may be provided with a light source 96 (e.g. a light emitting diode) and a detector 98 which can be a photodiode. As the amount of particulates in shaft 54 increases, part of the light originating from light source 96 is reflected back by the particulates and picked up by the photodiode 98. The signal from photodiode 98 is processed and amplified to produce an output signal 100 which is indicative of the amount of particulates in the exhaust from the second cyclone. Output signal 100 is transmitted to door actuator 102. Door actuator 102 may be any suitable means which can accept output signal 100 and move door 78 a predetermined amount in response to the specific output signal 100 which is received. Door actuator 102 may be connected to a 100-volt electrical source or to any other conveniently available power supply. Shaft 104 is provided so as to connect the door actuator to door 78. As shown in FIG. 6, shaft 104 is connected at one end to door actuator 102, and at the other end, to the rear surface 84 of door 78.

In operation, as the level of particulate emissions from the second cyclone increases, the level of particulates in shaft 54 also increases. This results in the increased reflection of light from light source 96 which is picked up by detector 98 and results in a specific output signal 100. Output signal 100 is indicative of the level of particulates in the exhaust air. This signal is transmitted to door actuator 102 which, in response to the output signal, causes door 78 to move from a first position in which the door restricts the flow of bled air through bleed valve 76 to a second position in which the door restricts the flow of bled air through bleed valve 76 to a lesser extent thus permitting an increased flow of bled air into the second cyclone in response to the increased amount of particulates detected in the exhaust air.

If a more simplistic system is utilised, then sensor 94 may produce only one output signal. In response to this output signal, door actuator 102 will cause door 78 to move from the closed position to a fully opened position when a level of particulate emission, above a predetermined limit, is detected in shaft 54. Alternatively, in a more complex system, sensor 94 may provide an output signal which varies linearly or in a different desired relationship with the level of particulates in shaft 54. As the level of particulates in shaft 54 increases above a predetermined level, a variable output signal is produced. In response to the signal, door actuator 102 causes door 78 to move from the closed position to a partially open position or from a partially open position to a more fully open position in response to the level of particulates in shaft 54. Thus as an increased or decreased amount of particulate emission is detected in shaft 54, door 78 may be opened or closed a predetermined amount to adjust the actual amount of bled air entering the second cyclone.

The invention can be applied to any type of vacuum cleaner including upright, cylinder, tank, back-pack and hand-held types. The invention, although described specifically in relation to a dual cyclonic vacuum cleaner, is equally applicable to a single cyclonic vacuum cleaner or to a cyclonic vacuum cleaner having more than two cyclones as will be apparent to one skilled in the art. Where more than one cyclone is used, bleed valves can be used to maintain the airflow in any one or more of the cyclones as necessary or desired.

We claim:

1. A vacuum cleaner comprising a dirty air inlet communicating with a clean air outlet by means of an airflow path, a cyclone being arranged in the airflow path such that, in use, air flowing along the airflow path from the dirty air inlet to the clean air outlet passes through the cyclone wherein at least one bleed valve is provided, downstream of the dirty air inlet for introducing bled air into the cyclone to maintain the air flow therein, wherein the bleed valve is normally closed such that no air is bled into the cyclone and wherein the bleed valve is opened when, in use, either the pressure of the air flowing along the airflow path falls to or below a predetermined level or the amount of particulates in the air at or adjacent the clean air outlet exceeds a predetermined level.

2. A vacuum cleaner as claimed in claim 1, wherein the at least one bleed valve is arranged in the wall of the airflow path upstream of the cyclone.

3. A vacuum cleaner as claimed in claim 2, wherein first and second cyclones are arranged sequentially in the airflow path, the at least one bleed valve being arranged between the two cyclones.

4. A vacuum cleaner as claimed in claim 1 wherein a plurality of bleed valves are provided adjacent one another.

5. A vacuum cleaner as claimed in claim 4, wherein the bleed valves are substantially identical to one another.

6. A vacuum cleaner as claimed in claim 4 wherein three bleed valves are provided adjacent one another.

7. A vacuum cleaner as claimed in claim 1 wherein the at least one bleed valve is are spring loaded.

8. A vacuum cleaner as claimed in claim 1 wherein the effective area of the at least one bleed valve is between 120 $mm^2$ and 150 $mm^2$.

9. A vacuum cleaner as claimed in claim 8, wherein the effective area of the at least one bleed valve is substantially 132 $mm^2$.

10. A vacuum cleaner as claimed in claim 1 wherein the at least one bleed valve comprises a door movable between a first position in which, in use, the flow of bled air through the at least one bleed valve is restricted and a second position in which, in use, the flow of bled air through the at least one bleed valve is restricted to a lesser extent than when the door is in the first position.

11. A vacuum cleaner as claimed in claim 10 wherein the position of the door is controlled by means responsive to the pressure of the airflow in the cyclone.

12. A vacuum cleaner as claimed in claim 10 wherein the position of the door is controlled by means responsive to the concentration of particulates in the air exhausted from the cyclone.

13. A vacuum cleaner as claimed in claim 1 wherein the at least one bleed valve is designed to open when the pressure in the airflow path is that produced by an airflow equivalent to an effective orifice of less than 15 mm diameter.

14. A vacuum cleaner as claimed in claim 13, wherein the at least one bleed valve is designed to open when the pressure in the airflow path is that produced by an airflow equivalent to an effective orifice of less than 13 mm diameter.

15. A vacuum cleaner as claimed in claim 1 wherein the amount of particulates in the air at or adjacent the clean air outlet is determined by means of a sensor provided downstream of the cyclone.

16. A vacuum cleaner as claimed in claim 15, wherein the sensor is provided with a light source and a detector.

17. A vacuum cleaner as claimed in claim 3 wherein the effective area of the at least one bleed valve is between 120 $mm^2$ and 150 $mm^2$.

18. A vacuum cleaner as claimed in claim 3 wherein the at least one bleed valve comprises a door movable between a first position in which, in use, the flow of bled air through the at least one bleed valve is restricted and a second position in which, in use, the flow of bled air through the at least one bleed valve is restricted to a lesser extent than when the door is in the first position.

19. A vacuum cleaner as claimed in claim 18 wherein the position of the door is controlled by means responsive to the pressure of the airflow in the second cyclone.

20. A vacuum cleaner as claimed in claim 18 wherein the position of the door is controlled by means responsive to the concentration of particulates in the air exhausted from the second cyclone.

21. A vacuum cleaner as claimed in claim 3 wherein the at least one bleed valve is designed to open when the pressure in the airflow path is that produced by an airflow equivalent to an effective orifice of less than 15 mm diameter.

22. A vacuum cleaner as claimed in claim 21 wherein the at least one bleed valve is designed to open when the pressure in the airflow path is that produced by an airflow equivalent to an effective orifice of less than 13 mm diameter.

23. A vacuum cleaner as claimed in claim 11 wherein the at least one bleed valve is designed to open when the pressure in the airflow path is that produced by an airflow equivalent to an effective orifice of less than 15 mm diameter.

24. A vacuum cleaner as claimed in claim 23 wherein the at least one bleed valve is designed to open when the pressure in the airflow path is that produced by an airflow equivalent to an effective orifice of less than 13 mm diameter.

25. A vacuum cleaner as claimed in claim 12 wherein the at least one bleed valve is designed to open when the pressure in the airflow path is that produced by an airflow equivalent to an effective orifice of less than 15 mm diameter.

26. A vacuum cleaner as claimed in claim 25 wherein the at least one bleed valve is designed to open when the pressure in the airflow path is that produced by an airflow equivalent to an effective orifice of less than 13 mm diameter.

27. A vacuum cleaner as claimed in claim 12 wherein the amount of particulates in the air at or adjacent the clean air outlet is determined by means of a sensor provided downstream of the cyclone.

28. A vacuum cleaner as claimed in claim 27 wherein the sensor is provided with a light source and a detector.

29. A method of operating a cyclonic vacuum cleaner having first and second cyclones arranged in series along an airflow path, comprising the steps of:

a) admitting dirty air into the first cyclone;

b) partially cleaning the dirty air in the first cyclone to produce partially filtered air;

c) conducting the partially filtered air from the first cyclone to the second cyclone;

d) further cleaning the partially filtered air in the second cyclone to produce further cleaned air; and e) exhausting the further cleaned air from the second cyclone through a clean air outlet wherein bled air is admitted, in addition to the partially filtered air, into the second cyclone only when either the pressure of the air flowing along the airflow path falls to or below a predetermined level or the amount of particulates in the air at or adjacent the clean air outlet exceeds a predetermined level for reducing particulates in the further cleaned air.

* * * * *